US005678091A

United States Patent [19]

Daspit

[11] Patent Number: 5,678,091

[45] Date of Patent: Oct. 14, 1997

[54] TURBID WATER DISPLACEMENT VIEWER FOR VIDIO AND THE LIKE

[76] Inventor: Ronald A. Daspit, 1301 E. Genie St., Parish of St. Bernard, La. 70043

[21] Appl. No.: 188,675

[22] Filed: Jan. 31, 1994

Related U.S. Application Data

[63] Continuation-in-part of Ser. No. 8,464, Jan. 25, 1993, abandoned.

[51] Int. Cl.[6] ..... B63C 11/00; G03B 17/08

[52] U.S. Cl. ..... 396/28; 396/29; 348/81; 348/375; 441/135

[58] Field of Search ..... 354/64; 358/99; 114/66; 441/135; 396/19, 25, 28, 29; 348/81, 373, 375

[56] References Cited

U.S. PATENT DOCUMENTS

| | | | |
|---|---|---|---|
| 2,396,267 | 3/1946 | Johnson | 354/64 |
| 3,482,903 | 12/1969 | Thomas et al. | 354/64 |
| 3,565,516 | 2/1971 | Thomas et al. | 354/64 |
| 3,596,582 | 8/1971 | Sayer | 354/64 |
| 3,838,434 | 9/1974 | Hughes et al. | 354/64 |
| 4,176,701 | 12/1979 | Welgan | 354/64 X |
| 4,465,468 | 8/1984 | Deacy | 441/135 |
| 4,536,789 | 8/1985 | Bains | 358/99 |
| 4,965,601 | 10/1990 | Canty | 358/99 X |
| 5,369,455 | 11/1994 | Mayer | 396/28 |

*Primary Examiner*—Safet Metjahic
*Assistant Examiner*—J. K. Han
*Attorney, Agent, or Firm*—William H. Maxwell

[57] ABSTRACT

A viewer and system for observing under water objects where conditions are turbid, characterized by a chamber open at one end adapted to interface with a field of view and closed by a window at the other viewing end where clear water is pumped into the chamber and displaces turbid waters therefrom, for high resolution viewing, ocularly or by objective camera lenses and with remote video monitoring, and providing a work chamber.

19 Claims, 4 Drawing Sheets

TURBID WATER DISPLACEMENT VIEWER FOR VIDIO AND THE LIKE

This is a continuation in part application of Ser. No. 08/008,464 filed Jan. 25, 1993, now abandoned.

BACKGROUND OF THE INVENTION

Under water visibility is greatly hampered by turbidity of the surrounding waters where construction and repair work is to be performed. That is, murky waters obscure the transmission of light from the object to be viewed, and from the lighting that is usually applied. Although the diver and/or cameras employed have low light capability, turbid waters are often too laden with suspended particulate matter for light transmission necessary for good viewing; either with the naked eye or with cameras for film exposure or of the video type. It is the particulate matter such as mineral particles and bio organisms in suspension that refract and reflect light to such an extent that satisfactory resolution cannot be attained. And, this condition exists even at close proximity of the viewer or camera to the object, since the high density of particulate matter destroys resolution of sight and or camera response. Accordingly, it is an object of this invention to provide this high resolution under water viewing system for sight and/or camera application.

In order for divers to perform adequately in turbid waters and for remote monitoring of his performance, under water video cameras are employed in order to view the workplace. Regardless of the light intensity and sensitivity of the eye or of the camera, refraction and reflection due to the density of particulate matter in solution will hinder diver and camera performance. In other words, suspended matter obscures vision, or reduces resolution to an intolerably low level. Therefore, it is an object of this invention to increase the resolution of the viewer or camera by removing particulate suspended matter from the waters in the field of view. With this invention the waters of high density particulate matter are displaced by clear waters, whereby refraction and reflection in the field of view are virtually eliminated. The result is high resolution viewing by the diver or by the cameras that are used. Displacement of turbid waters from the field of view is by means of a chamber provided for the reception and containment of clear waters, it being an object of this invention to provide a viewing chamber and turbid water displacement means.

It is the turbid waters in the field of view at and in front of the ocular lens of the eye or objective lens of the camera that is intolerable, and it is an object to remove said turbid waters. To this end a transparent extension is placed adjacent to and in front of said ocular or objective lens and sealed so as to exclude surrounding waters. A feature is the exposure of said transparent member in the aforesaid viewing chamber, for visibility along the axis of view.

It is an object of this invention to provide an effective turbid water displacement means, such that a front of clear water moves forwardly from the ocular or objective lens and into interface contact with the surface of the object to be viewed. With the exception of some dispersion and mixing as may be caused by cavitation, displacement of turbid waters from the viewing chamber is substantially complete. And, said displacement becomes virtually complete with the continued introduction of clear water. That is, there is a pressure front of clear water that displaces the turbid waters from the viewing chamber, said clear water being pumped into said chamber at a pressure in excess of the surrounding turbid waters at whatever depth.

The viewing chamber varies in size and shape dependent upon the object to be viewed or worked upon The object surfaces to be viewed are of varied geometrical shape and may be irregular by encrustation and/or damage, it being an object to accomodate these irregularities. Accordingly, the viewing chamber is open to embrace the area to be viewed and is provided with a flexible cuff having an edge adapted to conform to surface contours of the object contacted thereby. Contact of the cuff with the object is yielding, whereby waters are readily displaced from within the chamber, by flowing outwardly from beneath the cuff edge which functions as a check valve preventing re-entry of the displaced waters. The viewing chambers and cuffs are of varied configurations as shown and later described.

Lighting is quite necessary within the viewing chamber, it being an object of this invention to provide adequate lighting for camera operation and/or diver's vision by eye sight. A feature is the transparent extension member through which light is projected peripherally. It is to be understood that the transparent extension member is extended in front of the camera lens and/or in front of the diver's face plate, and that the chamber size is diminished or augmented as required by the object to be viewed or worked upon. Also, the viewing chamber can be a work chamber.

SUMMARY OF THE INVENTION

This invention relates to underwater inspection, construction and repair work and especially in adverse diving conditions where turbid waters are involved. In practice, turbidity can be so severe as to completely obscure vision, either by eyesight or by highly sensitive cameras. This is so because of the high density of particulate matter that reflects and refracts light and thereby destroys image resoluton. By removing these turbid waters from the field of view, the viewer of the present invention restores high resolution imagery to the diver and to camera equipment used for closed circuit monitoring of the object involved in the underwater workplace. The viewing system herein disclosed excludes turbid waters from the field of view and within a viewing area defined by a viewing chamber and/or work chamber characterized by a flexible cuff contacting the surface contour of the object to be viewed. Occluding turbid waters are removed from the viewing chamber by displacement with clear water pumped under pressure and applied to move forwardly in a pressure front followed by discharge beneath said cuff which acts as a check valve to prevent re-entry of the surrounding turbid waters. The object is viewed either ocularly by eye sight or objectively by camera and video monitoring.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
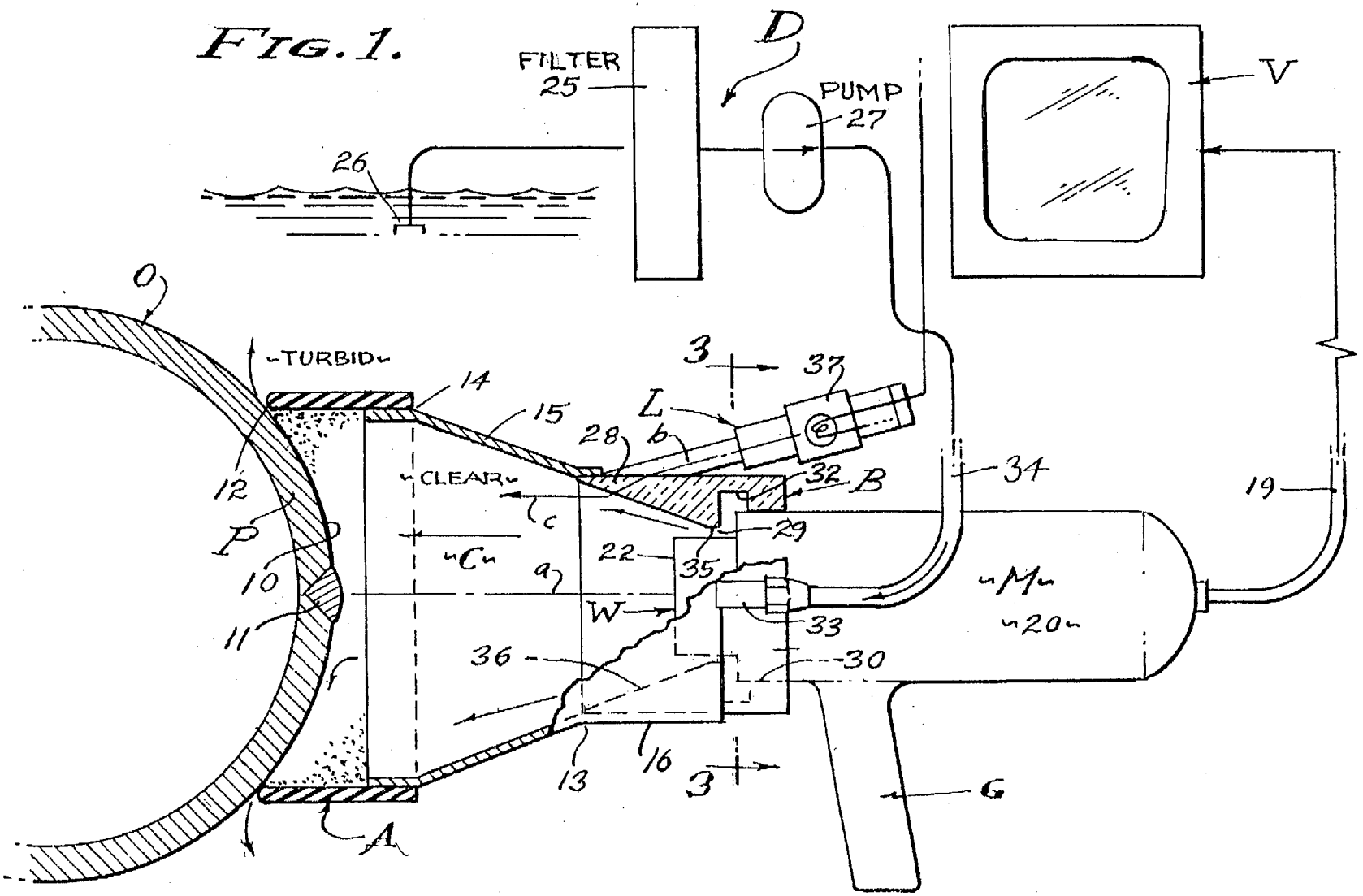
FIG. 1 is a side sectional view, partly in elevation and showing the system diagramatically.

Referring now to the drawings, the underwater viewer and system of the present invention is implemented for ocular viewing or for camera viewing, as may be required, and involves generally, a chamber C (primary) open to a field of view and closed by a transparent window W at which clear waters are introduced by hydraulic displacement means D for purging said chamber, and illuminating means L for lighting the field of view. The FIG. 1 embodiment is implemented for video monitoring the field of view, and includes a photo optical detector and video scanner means M to be viewed at a video screen means V; that is, by remote persons involved with the work place activity. The FIG. 4 embodiment is implemented for face plate observation of the field of view, and includes a secondary chamber C' open to the diver's face plate and purged by said hydraulic displacement means.

It is turbid waters that are displaced from the chambers C and C', progressing away from the window W and in the form of a clear water front that interfaces with the field of view, and in the second embodiment also with the face plate. For example, the object 0 is the semi cylindrical side wall 10 of a pipe P having a seam weld 11 to be inspected and/or repaired. A feature is the flexible cuff A that surrounds the chamber and interfaces with the object surface 10 and adapts the viewer to the object 0. Another feature is the chamber body B that surrounds the window W and provides a displacement port for introducing clear water to the chamber,or chambers, establishing the clear water displacement front or fronts.

Figure 5:
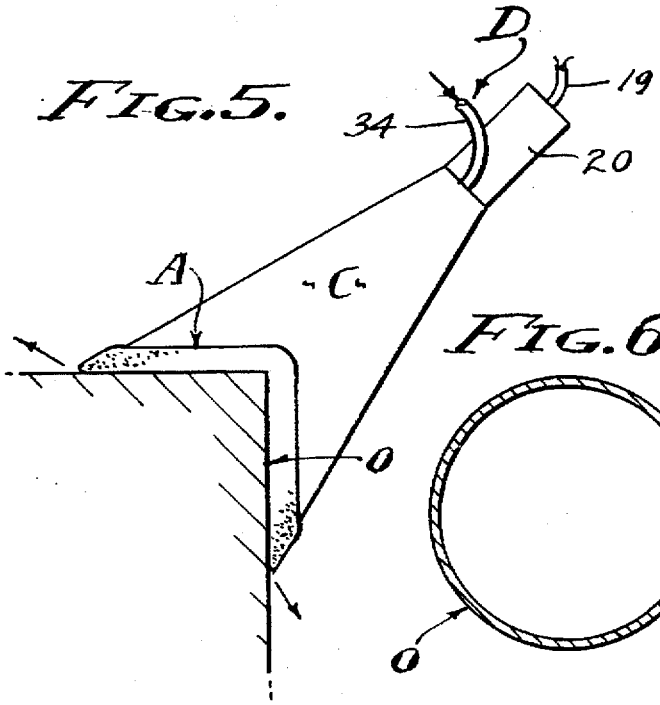
FIGS. 5, 6 and 7 illustrate typical viewing chambers, FIG. 5 adapted to embracement of a corner situation, FIG. 6 adapted to a circular area of view, and FIG. 7 to a rectangular area of view.
Figure 6:
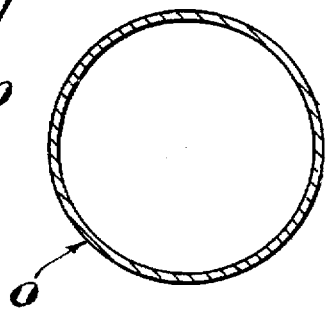
Figure 7:
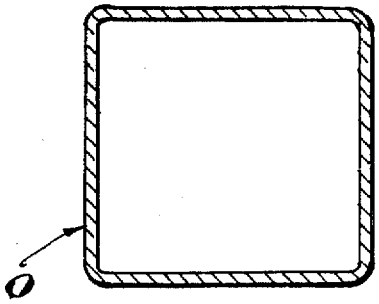

The object 0 to be viewed will be irregular and will vary in shape and size. The field of view may be convex as shown in FIG. 1, or concave, or it may be an exterior corner as shown in FIG. 5, or an interior corner; corners of any angularity. Accordingly, this invention provides the cuff A that interfaces with the wall 10 of the object 0. In the FIG. 1 embodiment the cuff A has a concaved edge 12 that is complementary to the convex surface of wall 10. That is, the interfacing edge 12 of cuff A is shaped to complement the object to be viewed; convexly, concavely, angularly and irregularly, and as circumstances require.

Figure 2:
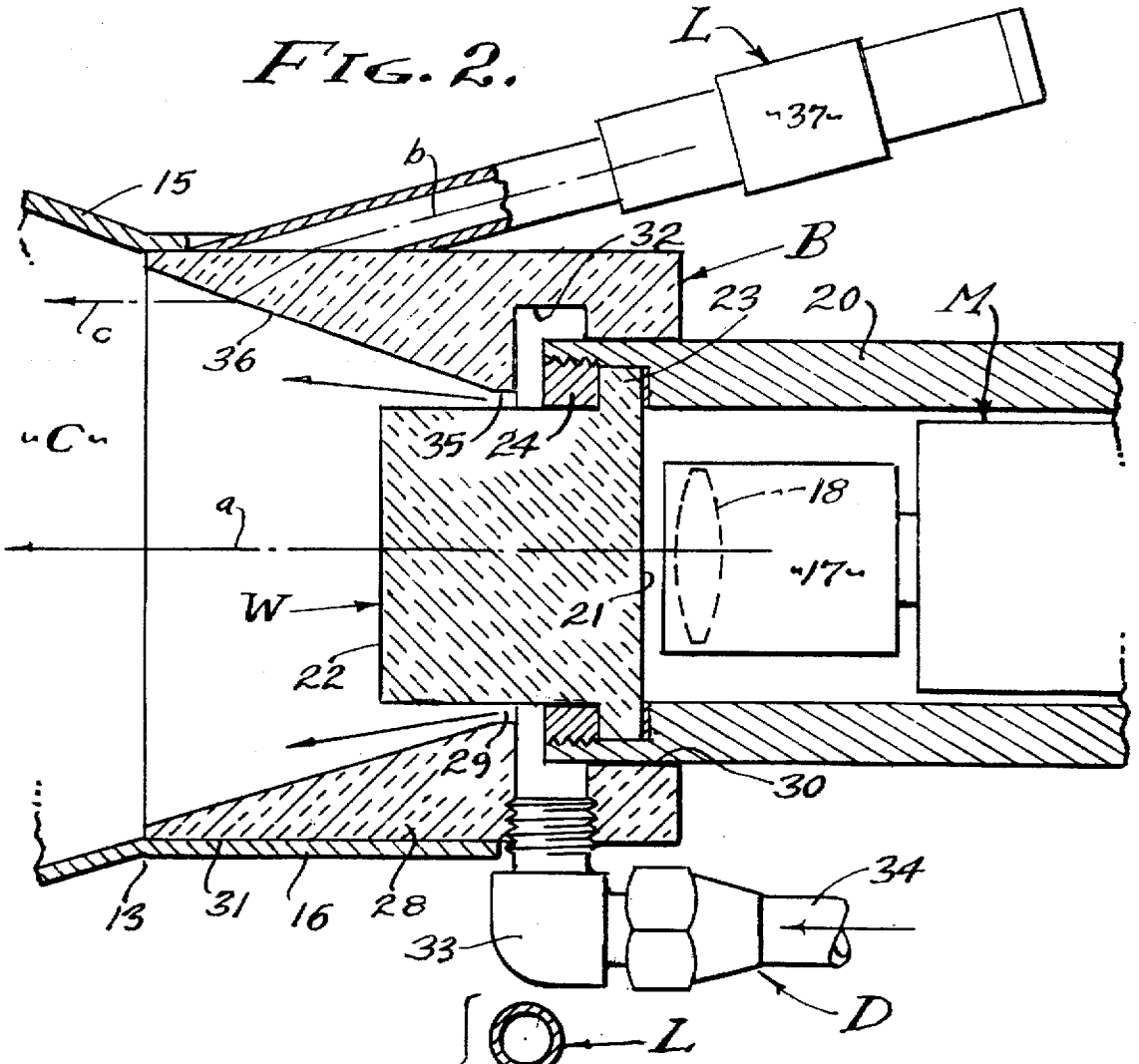
FIG. 2 is an enlarged detailed sectional view of the viewer of the present invention as it is related to the photo-optical-detector portion of a video camera.
Figure 3:
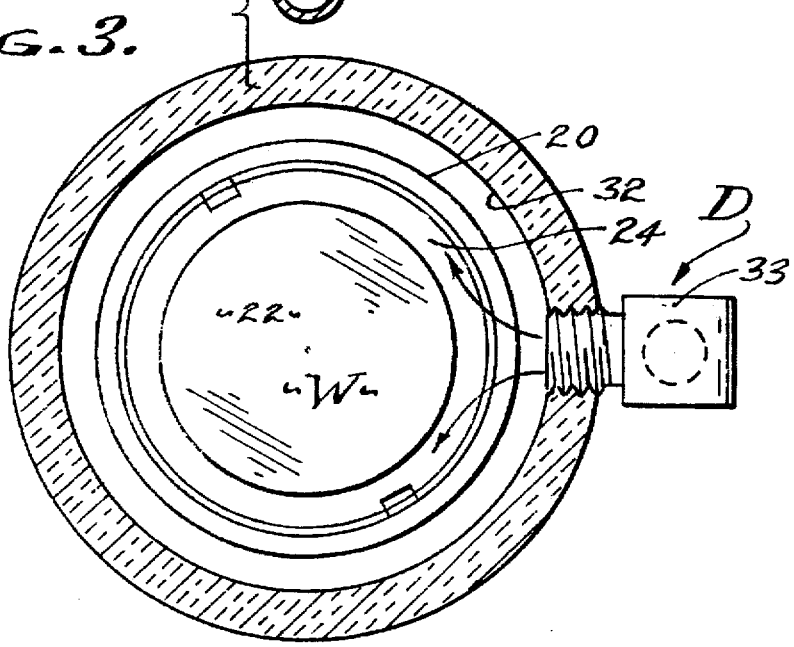
FIG. 3 is an enlarged sectional view taken as indicated by line 3—3 on FIG. 1.

Referring now to FIGS. 1, 2 and 3 of the drawings, chamber C is an elongate tube that is divergent from its smaller viewing end 13 to its larger field of view end 14. The cross sectional configuration of chamber C varies and is indicated as being a round wall 15 of cone shape carried by and extending forwardly from a cylindrical support flange 16 having a diameter corresponding to that of the camera housing later described. The wall 15 and flange 16 are imperforate, and with the integral cuff function to separate the interior of chamber C from the surrounding turbid waters. In accordance with this invention the cuff A is made of flexible material such as of rubber or the like that conforms to irregularities in or on the surface of the object wall 10, and such as to yield to interior clear water pressure within the chamber; that is, interior pressure in excess of exterior pressure. When the edge 12 is interfaced with the wall 10, or when in close proximity thereto, and with the chamber C pressured in excess of the surrounding pressure, said chamber wall 15 establishes an isolating barrier that contains the clear water introduced within chamber C as will be described.

The underwater video monitoring system embodiment includes an optical detector means 17 having an objective lens 18 on the axis of view a, and having a scanner means M with amplification for transmitting a video signal through conductors 19 to a video screening means V. The underwater elements of the video system are sealed in a water tight housing 20 from which water tight conductors 19 emanate and extend to the screening means V. In accordance with this invention I provide the transparent window W that hermetically closes the camera housing 20, positioned adjacent to and in front of the objective lens 18. As shown, the window W is an elongated solid of transparent optical material, for example of clear acrylic plastic, having parallel back and front polished faces 21 and 22 for image transmission without refraction. The window W is captured in place and to the housing 20 by a peripheral flange 23 at the back face 21, and secured by a retainer ring 24 threaded into said housing. The window W is a solid body of said transparent material that projects forwardly into the chamber C for controlling the introduction of clear water, as next described.

The hydraulic displacement means D is provided for introducing clear water into the chamber C at and surrounding the window W, thereby establishing a clear water front that moves forwardly until it interfaces with the field of view wall 10 of the object 0, where it displaces turbid waters from the chamber C. In practice, the introduction of clear water is continuous, so that clear water continues to discharge at the cuff edge 12 and into the surrounding turbid waters.

Clear water is from a remote source as shown, and is ensured by providing a filter 25 drawing water from a surface source at 26 and delivered under pressure by a pump 27, exceeding the water pressure at the depth of the viewer, whatever it may be. The clear water is delivered to a body 28 that surrounds the window W and forms an annular port 29 over the cylindrical exterior of the forwardly projecting window. In practice, the body 28 is an adapter member that attaches the camera housing 20 to the flange 16 of the chamber having a rearwardly opening socket 30 to receive and secure the camera housing 20, and having a forwardly extending exterior diameter 31 to receive and secure chamber flange 16. The interior of the body 28 is counterbored at 32 to receive clear water from a hydraulic fitting 33, through a flexible hose 34. The annular port 29 is formed by a bore 35 concentrically spaced around the cylindrical exterior of the projecting window W and open into said counterbore. Accordingly, clear water flows coextensively around the cylindrical exterior of window W and within the wall 15 of the chamber C. As shown, the interior 36 and exterior diameter 31 of body 28 are convergent forwardly so that the interior continues conically into the wall 15 of the chamber C. The adapter body 28 or housing 20 can be hand held by means of a grip G.

The field of view can be illuminated by light admitted to the chamber through a transparent chamber wall 15, or preferably by illuminating means L projecting light into the chamber C that is otherwise obscured by turbidity or by an opaque wall 15. As shown, the means L is incorporated in the adapter body 28 and projects light through the body 28 and into the chamber C. A feature is that the adapter body 28 is made of transparent material such as acrylic plastic, through which light projecting means 37 directs light forwardly as shown on an axis b. The axis b light projection is at an acute angle as it enters the longitudinal periphery of the tranparent body 28, and said light being refracted by the conically angular wall 36 to an axis c substantially parallel with axis a. That is, the light projection is refracted so as to be substantially normal to the field of view. There is at least one and preferably a plurality of illuminating means L spaced around the body 28 as may be required.

Figure 4:
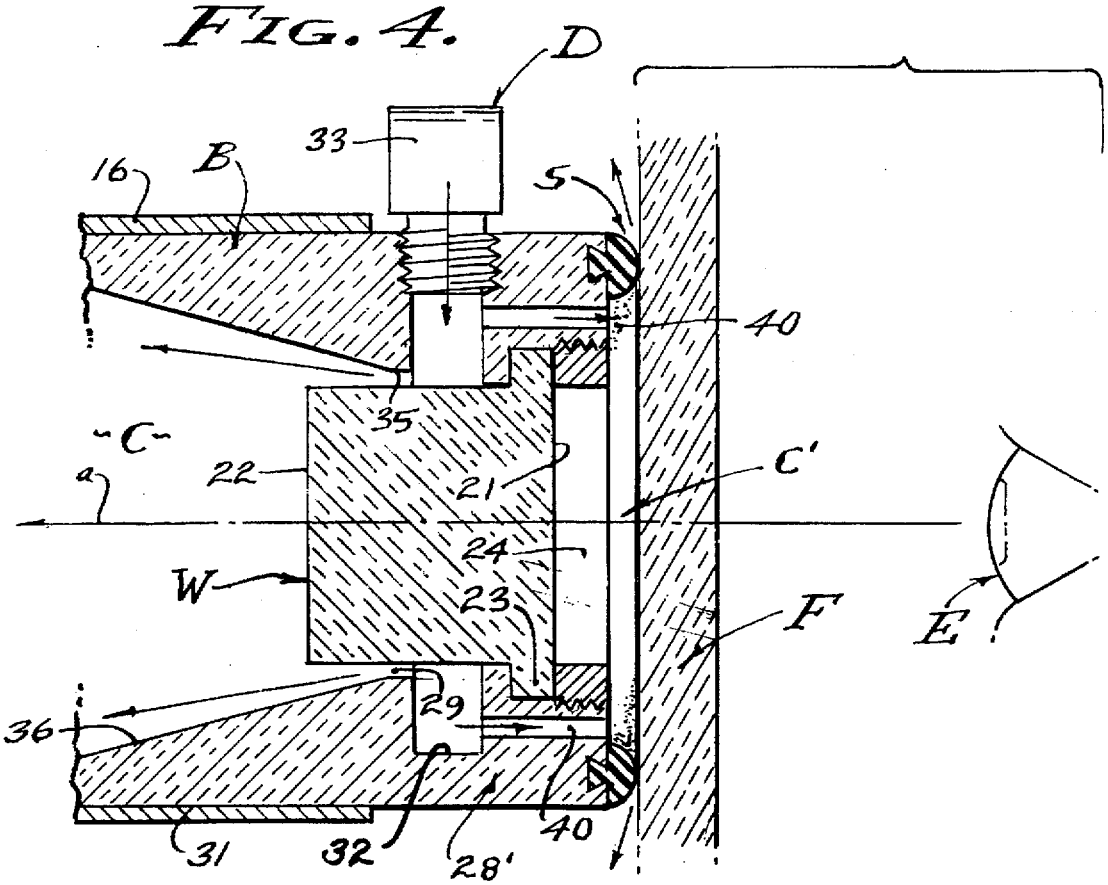
FIG. 4 is an enlarged detailed sectional view similar to FIG. 2 showing the viewer of the present invention as it is related to a diver's face plate for direct viewing.

Referring now to FIG. 4 of the drawings, the viewer is implemented for face plate viewing by a diver. The chamber C, cuff A, window W and displacement means D remain as hereinabove described, and it is to be understood that the window W can be substituted for a face plate. As shown, the adapter body 28' is modified to receive a face plate F, rather than a camera housing 20. Accordingly, the face plate F is positioned closely adjacent to the back face 21 of window W, establishing a secondary chamber C' that is also purged of turbid waters by the displacement means L that is provided with one or more clear water discharge passages 40 from counterbore 32 and into said chamber C'. In this embodiment the peripheral flange 23 of window W is received by a rearwardly open socket in the adapter body 28' and secured by the retainer ring 24 threaded therein. The back of the body 28' is preferably coplanar with the back of said retainer ring, there being a peripheral seal S of depressible material such as rubber or the like surrounding the window W to interface with the face plate F. Accordingly, clear water introduced through passages 40 displaces turbid waters from the chamber C', enabled as by manipulation by the diver to release turbid water as may be required for clear visibility. The diver's eye E observes the field of view along the axis a.

Figure 8:
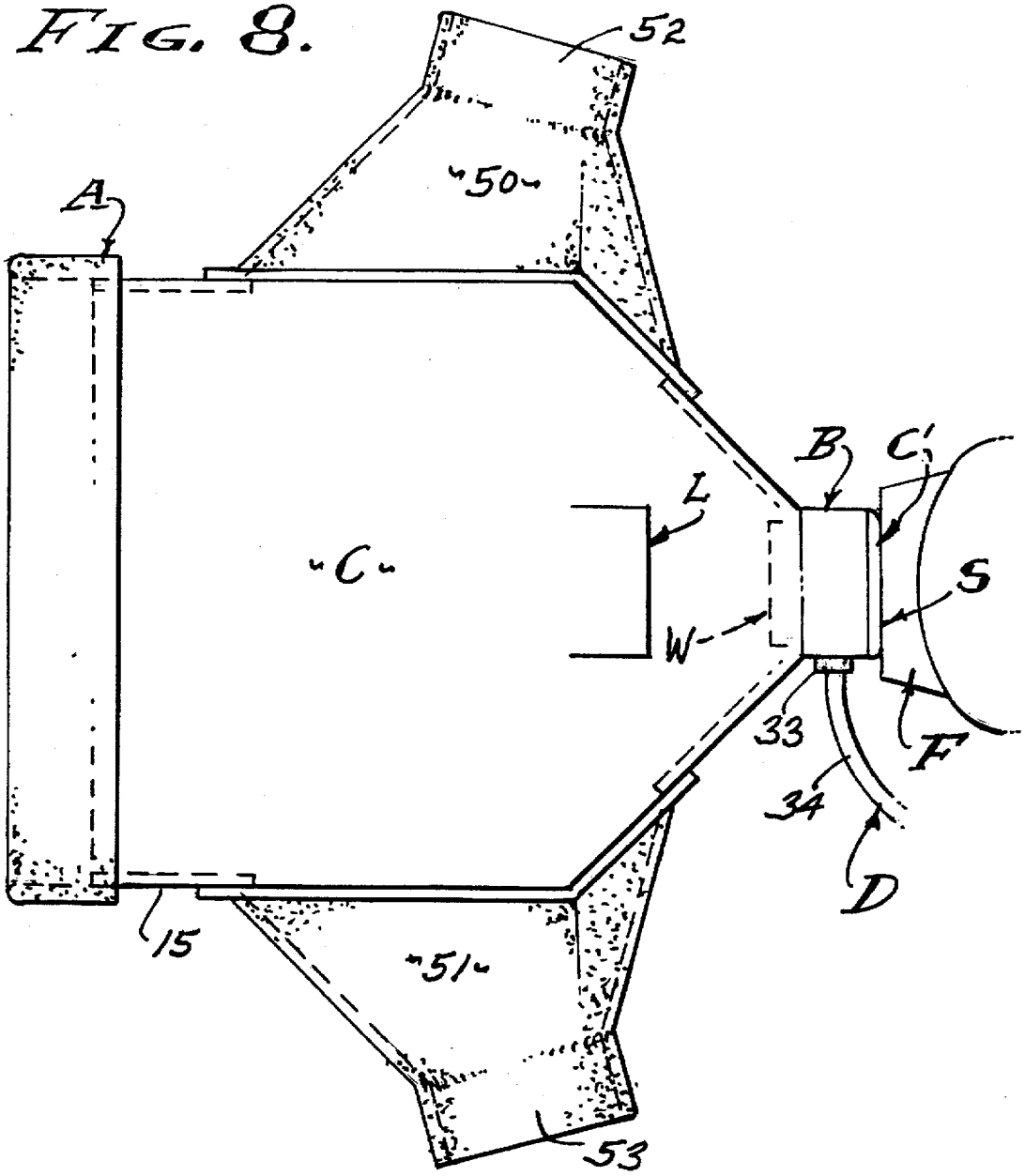
FIG. 8 is a plan view of the viewer in the form of a work place for a diver, and is adapted for the manipulation of tools and the like within the chamber.

It is to be understood that the chamber C can be augmented and shaped into a work place to accomodate work implementation with access means through the wall 15 for manipulation, as may be required. As shown is FIG. 8 of the drawings, the chamber C is a work chamber that is enlarged to provide space for the manipulation of tools and the like (not shown). Access to the chamber C is by sleeves 50 and 51 with cuffs 52 and 53 to fit over the wrists and/or arms of the diver who enters his hands into the chamber C for inspection purposes, to take samples from the surface being observed, and to make repaires etc. The sleeves 50 and 51 are at opposite sides of the tubular wall 15 and open into the chamber C. The sleeves and cuffs are made of flexible material and the cuffs are preferably elastic so as to fit tight over the wrists and arms of the diver. As shown, the divers face plate F is employed as hereinabove described with respect to FIG. 4 of the drawings.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A turbid water displacement viewer and system for under water observation of a field of view otherwise obscured partially or completely by intervening turbid water, and including;

an imperforate tubular wall extending forwardly along an axis of view from a back viewing end to an open front end having an edge conforming generally with and to engage at least partially with a shape of an object to be viewed and forming an unobstructed chamber within the tubular wall and isolated from the turbid surrounding waters when said edge is closely interfaced with said object for water discharge from the chamber, a transparent window closing the back viewing end and disposed on said axis of view for viewing said object at the field of view, hydraulic displacement means for introducing clear water into the chamber between said back viewing end and said open front end for discharge of water between the closely interfaced edge of the tubular wall and said object, displacing turbid water with clear water that is transparent, and illuminating means for illuminating the field of view within said chamber.

2. The turbid water displacement viewer and system as set forth in claim 1, wherein said edge of the imperforate tubular wall conforms to irregularities in and engaging a wall of the object to be viewed.

3. The turbid water displacement viewer and system as set forth in claim 1, wherein the edge of said open front end of the tubular wall carries a flexible cuff conforming to irregularities in and engaging a wall of the object to be viewed.

4. The turbid water displacement viewer and system as set forth in claim 1, wherein said back viewing end of the imperforate tubular wall is closed by a body that receives the transparent window at which a port through the body introduces clear water from the hydraulic displacement means for discharge of clear water from the open front end of the tubular wall.

5. The turbid water displacement viewer as set forth in claim 4, wherein the body closing the viewing end of the chamber is transparent, and wherein the illuminating means is at least one light projecting means directing light through said transparent body and into the said chamber.

6. The turbid water displacement viewer and system as set froth in claim 1, wherein said back viewing end of the chamber is closed by a body that receives and surrounds the transparent window with an annular port to introduce clear water from the hydraulic displacement means for discharging a forwardly extending clear water front from the open front end of the tubular wall.

7. The turbid water displacement viewer and system as set forth in claim 1, wherein the transparent window is elongated along the axis of view and comprised of a cylindrical exterior and spaced back and front parallel faces for non-refractive light transmission, the said back viewing end of the chamber being closed by a body with a bore concentric with and surrounding the cylindrical exterior of the transparent window and forming an annular port to introduce clear water from the hydraulic displacement means for discharging a forwardly extending clear water front to the open front field of view end.

8. The turbid water displacement viewer and system as set forth in claim 7, wherein the body closing the viewing end of the chamber is transparent with forwardly convergent exterior and interior walls, and wherein the illuminating means is at least one light projecting means refracting light through said converging walls of the transparent body and to the field of view.

9. The turbid water displacement viewer and system as set forth in claim 1, wherein the hydraulic displacement means is comprised of a pump supplying clear water at a pressure at least equal to and in excess of the turbid water surrounding said viewer.

10. The turbid water displacement viewer and system as set forth in claim 1, wherein the illuminating means is the chamber wall comprised of light transmitting material.

11. The turbid water displacement viewer and system as set forth in claim 1, wherein the illuminating means is at least one light projecting means directing light into the said chamber.

12. A turbid water displacement viewer and camera system for under water observation of a field of view otherwise obscured partially or completely by intervening turbid water, and including;

an imperforate tubular wall extending forwardly along an axis of view from a back viewing end to an open front end having an edge conforming generally with an to engage at least partially with a shape of an object to be viewed, said back viewing end being closed by a body with a rearwardly opening socket, and forming an unobstructed chamber within the tubular wall and isolated from the turbid surrounding water when said edge is closely interfaced with said object for water discharge, from the chamber, a transparent window received in the body and closing the back viewing end of the chamber and disposed on said axis of view for viewing said object at the field of view, hydraulic displacement means for introducing clear water into the chamber between said back viewing end and said open front end for discharge of water between the closely interfaced edge of the tubular wall and said object, displacing turbid waters with clear water that is transparent, illuminating means for illuminating the field of view within said chamber, and a forwardly faced camera means carried in said socket and having an objective lens at said transparent window and on said axis of view.

13. The turbid water displacement viewer and camera system as set forth in claim 12, wherein the camera means is comprised of an optical detector means and a scanner means with amplifier means having a cable connecting to a remote video screening means.

14. A turbid water displacement viewer and transparent face plate and system for under water diver observation of a field of view otherwise obscured partially or completely by intervening turbid water, and including, an imperforate tubular wall extending forwardly along an axis of view from a back viewing end to an open front end having an edge conforming generally with and to engage at least partially with a shape of an object to be observed, said back viewing end being closed by a body having a surrounding rearwardly faced seal and forming an unobstructed primary chamber within the tubular wall and isolated from the turbid surrounding water when said edge is closely interfaced with said object for water discharge from the primary chamber, A transparent window received in the body within said rearwardly faced seal and closing the back viewing end of the primary chamber and disposed on said axis of view, illuminating means for illuminating the field of view within said primary chamber, the rearwardly faced seal being engageable with the transparent face plate and forming a secondary chamber between said transparent window and said transparent face plate, and hydraulic displacement means for introducing clear water into the primary and secondary chambers, replacing turbid water with clear water that is transparent.

15. The turbid water displacement viewer and face plate system as set forth in claim 14, wherein the primary chamber is a diver's work chamber to accomodate workplace implements.

16. The turbid water displacement viewer and face plate system as set forth in claim 14, wherein the primary chamber is a diver's work chamber with at least one side opening for entry of a diver's arm for manipulative work within said chamber.

17. The turbid water displacement viewer and face plate system as set forth in claim 14, wherein at least one side sleeve opens into the primary chamber for entry therethrough of a diver's arm for manipulative work within said chamber.

18. The turbid water displacement viewer and face plate system as set forth in claim 14, wherein at least one side sleeve opens into the primary chamber and with an elastic cuff to tightly engage over the diver's arm adapted to enter therethrough for manipulative work within said chamber.

19. The turbid water displacement viewer and face plate system as set forth in claim 14, wherein opposite side sleeves open into the primary chamber and each with an elastic cuff to tightly engage over the diver's arms adapted to enter therethrough for manipulative work within said chamber.

* * * * *